US006823627B1

(12) United States Patent
Ben-Ezra

(10) Patent No.: US 6,823,627 B1
(45) Date of Patent: Nov. 30, 2004

(54) SECURITY DOOR SHIELD

(75) Inventor: Isaac Ben-Ezra, West Bloomfield, MI (US)

(73) Assignee: Palladium Manufacturing Company, LLC, Redford, MI (US)

( * ) Notice: Subject to any disclaimer, the term of this patent is extended or adjusted under 35 U.S.C. 154(b) by 22 days.

(21) Appl. No.: 10/178,846

(22) Filed: Jun. 25, 2002

(51) Int. Cl.[7] ..... E05B 65/06; E05B 17/00; E05B 17/14

(52) U.S. Cl. ..... 49/394; 70/424; 70/417

(58) Field of Search ..... 49/67, 61, 62, 49/63, 50, 57, 141, 394, 460, 270; 70/416, 455, 423, 424, 417; 292/346

(56) References Cited

U.S. PATENT DOCUMENTS 4,226,104 A * 10/1980 Oliver ..... 70/455
4,644,688 A 2/1987 Benderoff ..... 49/67
4,679,418 A * 7/1987 Allen ..... 70/380
4,838,059 A * 6/1989 Johnson ..... 70/209
4,899,564 A * 2/1990 Gilbert ..... 70/428
5,003,803 A * 4/1991 Richards ..... 70/416
5,201,202 A * 4/1993 Kam ..... 70/168
5,865,050 A * 2/1999 Michaud et al. ..... 70/416
5,934,122 A * 8/1999 Edwards et al. ..... 70/416
6,324,879 B1 * 12/2001 Kennedy ..... 70/416

* cited by examiner

*Primary Examiner*—Hugh B. Thompson, II
(74) *Attorney, Agent, or Firm*—Alex Rhodes

(57) ABSTRACT

A method and kit for retrofitting security doors to facilitate escaping from buildings during emergencies. One benefit is that it applies to new security doors as well as existing security doors. Still yet another benefit is that it can be molded from a corrosion resistant plastic. Still yet another benefit is that only basic hand tools are required for retrofitting existing doors. The kit is comprised of a simple separable shield having a thin outer wall portion for enclosing an unlocking member and an orthogonal portion for retaining the shield in a security door. In one aspect of the invention the shield is mounted in fixed relationship to the security door. In a second aspect, the shield is mounted in rotating relationship to the security door. The method is comprised of the steps of removing a lock member, installing the shield and re-installing the lock member.

8 Claims, 5 Drawing Sheets

SECURITY DOOR SHIELD

FIELD OF THE INVENTION

This invention relates to security closures and more particularly to a simple, cost effective method and kit for retrofitting security doors with a means for escaping from a building during an emergency.

BACKGROUND OF THE INVENTION

Security doors prevent unlawful entries into buildings. They have locks which can be locked with keys from inside a building. This feature provides security when entrance doors are open.

One problem with security doors is that locks prevent occupants from leaving buildings when keys are unavailable. One solution is to store spare keys close to security doors. This solution is not entirely satisfactory because spare keys can be removed and when stored away from a door are not always evident during emergencies.

Another solution is disclosed in Benderoff U.S. Pat. No. 4,644,688. Benderoff teaches welding a protective shield on the inside of a security door and storing a spare key in the shield. The shield places the key in the immediate view of an occupant and prevents a removal of the key by an intruder reaching through an opening in the security door. One drawback with this solution is that it is a not practical solution for retrofitting the large numbers of existing security doors.

Moreover, welding causes fires and can damage objects which are near a door. It also requires a re-finishing of a security door. The removal of a door would lessen these problems, however removal and re-installation of the door is costly and time consuming. Since most security doors are owned by homeowners with limited resources, many homeowners will not pay for a time consuming, expensive solution. To be effective, the solution must be simple and cost effective.

SUMMARY OF THE INVENTION

The present invention is a simple, cost effective method and kit for retrofitting security doors with a means for escaping from a building during emergencies. Another benefit is that it applies to new security doors as well as existing security doors. Still yet another benefit is that it can be molded from a corrosion resistant plastic. Still yet another benefit is that only basic hand tools are required for retrofitting existing doors.

The kit is comprised of a simple separable shield; and a fastening means for mechanically attaching the shield to a security door. As used herein, the phrase, "mechanically attaching" means without welding. In a first aspect of the invention, the shield is attached in fixed relationship to a rear surface of a security door. In a second aspect, the shield is attached in rotating relationship to a security door.

The method is comprised of the steps of mechanically removing a lock member, installing the shield and re-installing the lock member.

In employing the teaching of the present invention, a plurality of alternate constructions can be adopted to achieve the desired results and capabilities. In this disclosure, only several aspects of the invention are discussed. However, these aspects are intended as examples and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a preferred embodiment of the invention by way of non-limiting example only.

FIG. 10 is an enlarged end elevation view of the second embodiment.

DETAILED DESCRIPTION OF A PREFERRED EMBODIMENT

Figures 1, 2:
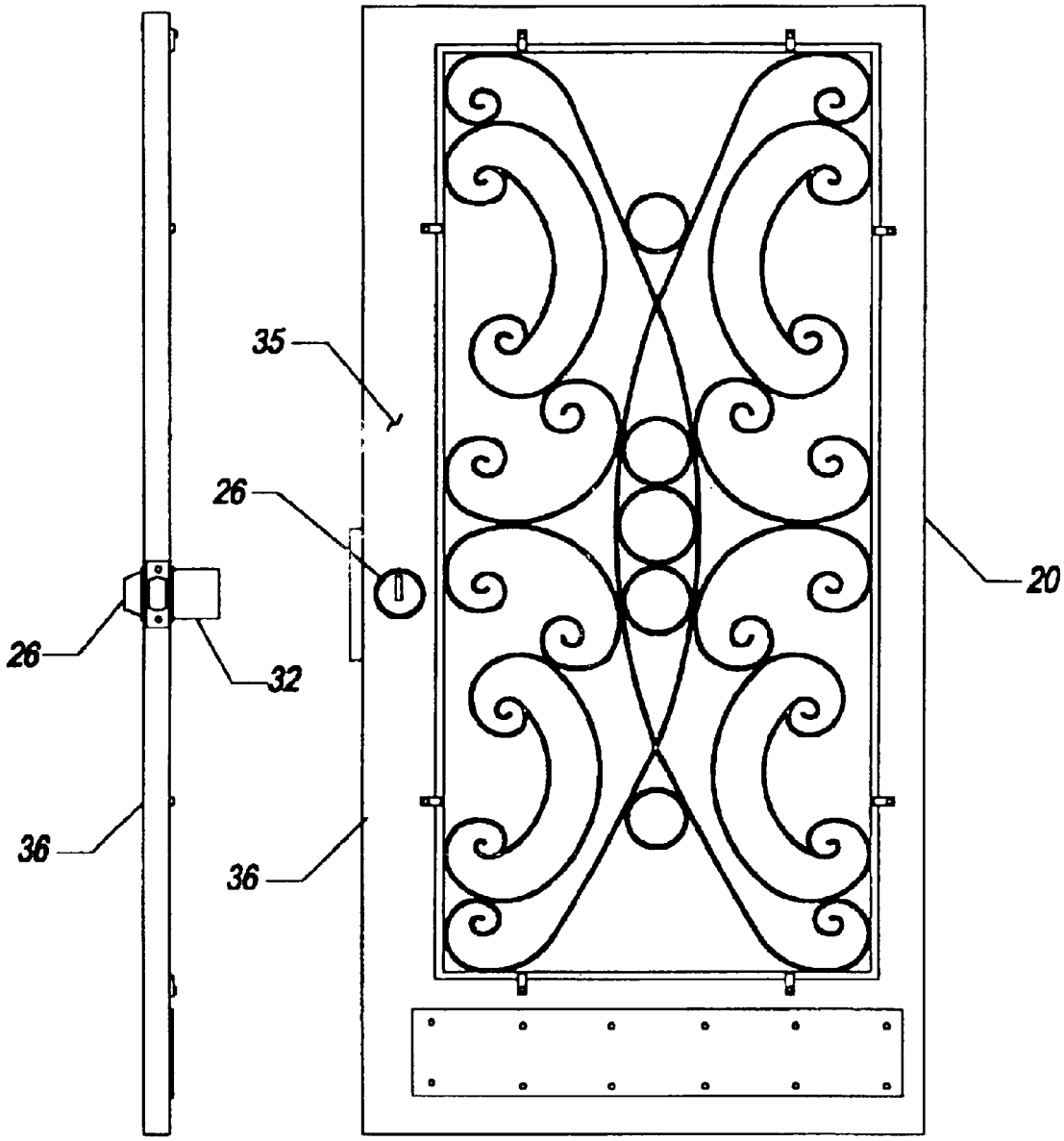
FIG. 1 is a rear elevation view of a security door according to the present invention.
FIG. 2 is an end elevation of the security door.
Figure 3:
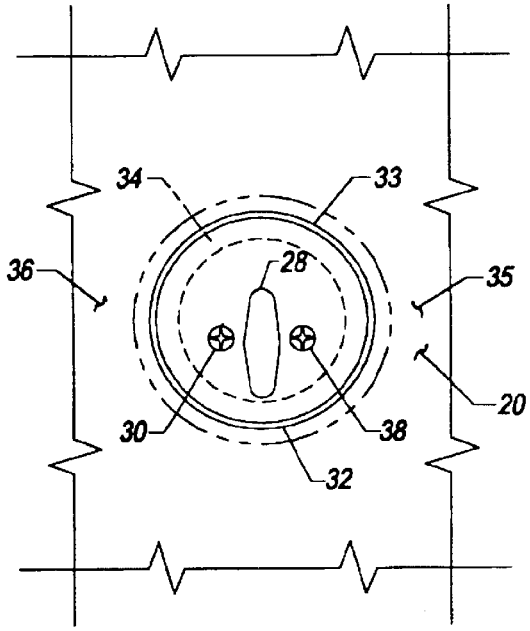
FIG. 3 is an enlarged partial rear elevation view of the security door.
Figure 4:
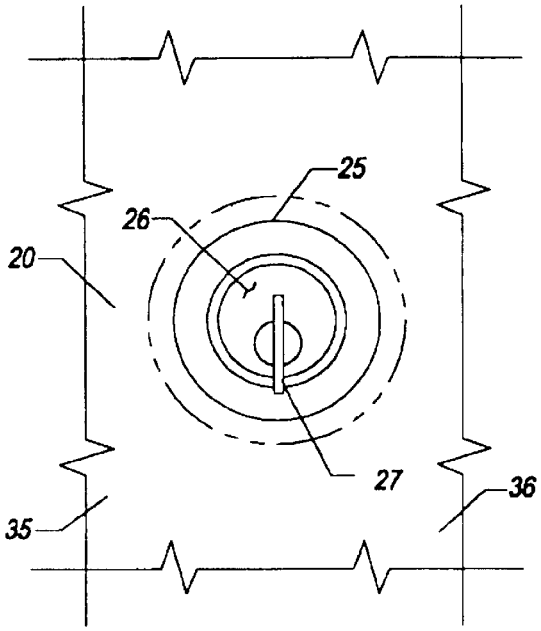
FIG. 4. is an enlarged partial front elevation view of the security door.

Referring now to the drawings wherein like numerals designate like and corresponding parts throughout the several views, a security door 20 is shown in FIGS. 1 through 4, inclusive, which embodies the present invention. The security door 20 is spaced a short distance in front of a prime entrance door, shown in phantom and designated by the letter "A". The security door 20 is a conventional grated structure, consisting of an arrangement of spaced apart hollow rectangular tubes and bars, joined together by welding. In opposite walls of one of the upright tubes 36 of the grated structure is a conventional single cylinder deadbolt lock 24.

The single cylinder deadbolt lock 26 is a usual type of lock, having an outer bezel 25, a key 27, a rotatable tang 28, an inner bezel 29, and a pair of threaded fasteners 30. The tang 28 is retained to the inner bezel 29 with a circlet clip 31. The lock 26 can be locked or unlocked by rotating the tang 28 from the interior of a building or rotating the key 27 from the exterior of the building. The lock 26 is retained in the security door 20 with the inner bezel 29 and the two threaded fasteners 30 which engage the deadbolt assembly 26.

Figure 5:
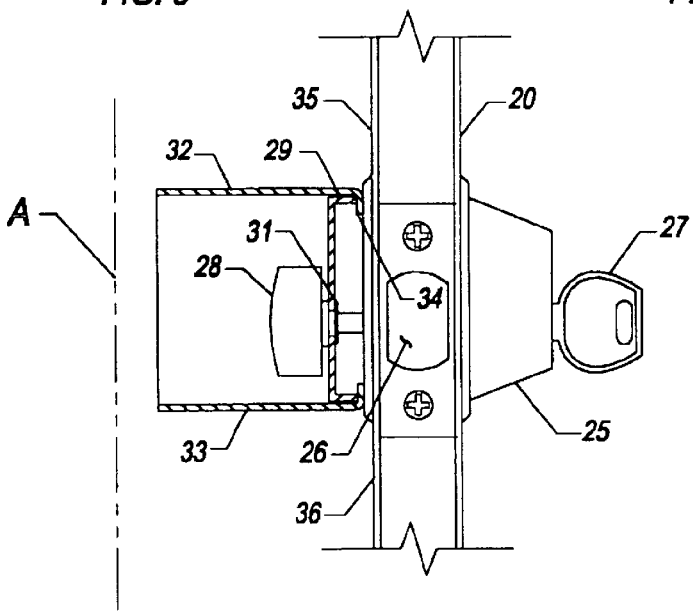
FIG. 5 is an enlarged end elevation view of the security door.
Figure 6:
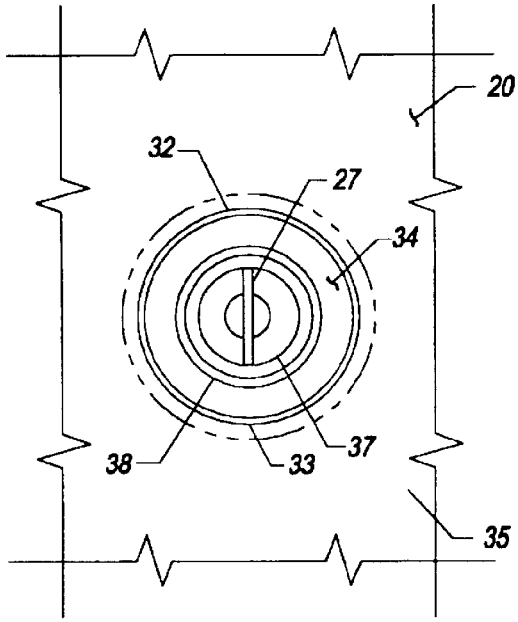
FIG. 6 is an enlarged partial rear elevation view of a second embodiment.
Figure 7:
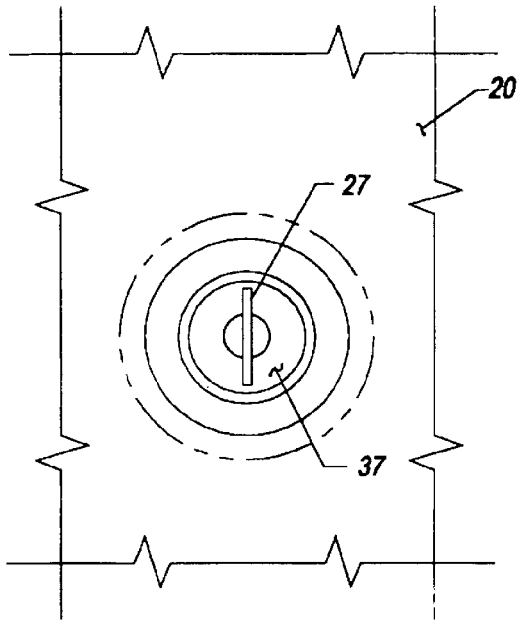
FIG. 7. is an enlarged partial front elevation view of the second embodiment.
Figure 8:
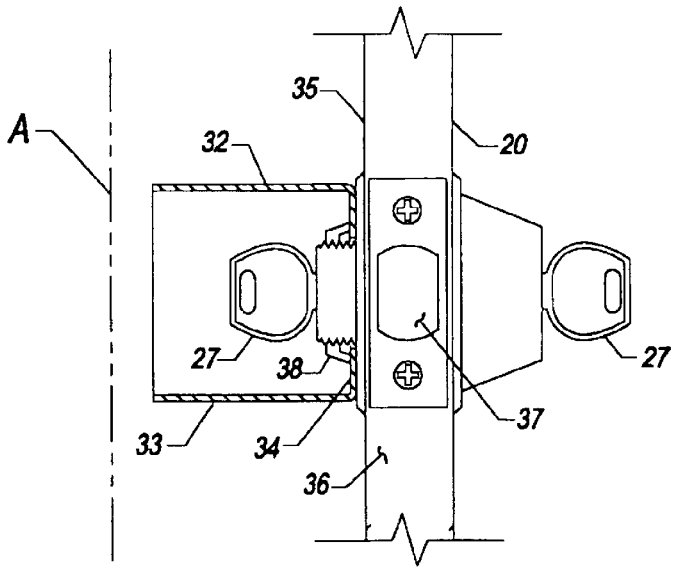
FIG. 8 is an enlarged end elevation view of the second embodiment.

With reference to FIG. 5, on the interior side of the security door 20 there is a separable cylindrical protective shield 32 which surrounds the rotatable tang 28 and prevents access by an intruder to the tang 28 from the exterior side of the door 20 by reaching through an opening in the security door 20. The shield 32 has a thin cylindrical portion 33 which surrounds the tang 28 and an orthogonal portion 34 which retains the shield 32 to the security door 20.

The shield 32 is clamped in fixed relationship to a rear face 35 of the vertical tubular member 36 by the threaded fasteners 30 and the inner bezel 29. To install the shield 32 in the security door 20, it is only necessary to remove the inner bezel 29 by first removing the threaded fasteners 30, place the orthogonal portion 34 of the shield 32 against the vertical member 36, and re-install the inner bezel 29 and the threaded fasteners 30.

In FIGS. 5 through 8, inclusive, the separable protective shield 32 is shown in combination with the security door 20 and a double cylinder deadbolt lock 37. The deadbolt lock 37 is retained in the security door 20 with an inner bezel 38 which threadably engages the double cylinder deadbolt lock 37. To install the shield 32, it is only necessary to remove the inner bezel 38, position the inward facing flange of the shield 34 against the security door 20 and re-install the inner bezel 38.

Figure 9:
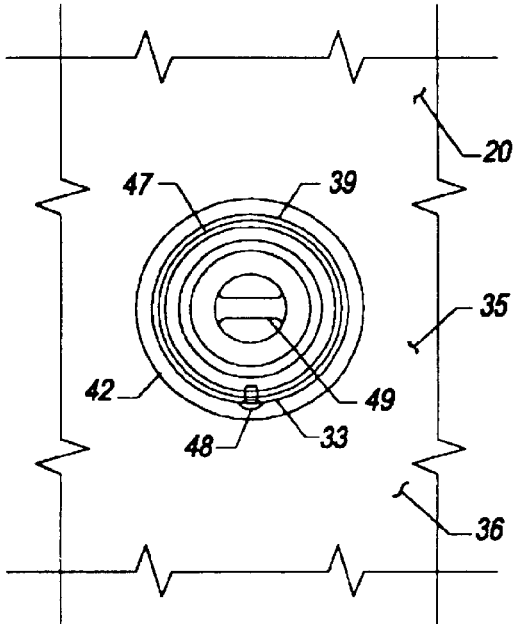
FIG. 9 is an enlarged partial rear elevation view of a second embodiment.
Figure 10:
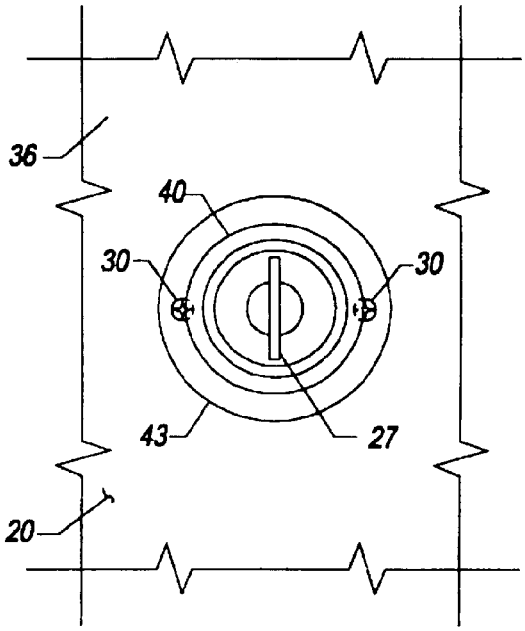
FIG. 10 is an enlarged partial front elevation view of the second embodiment.
Figure 11:
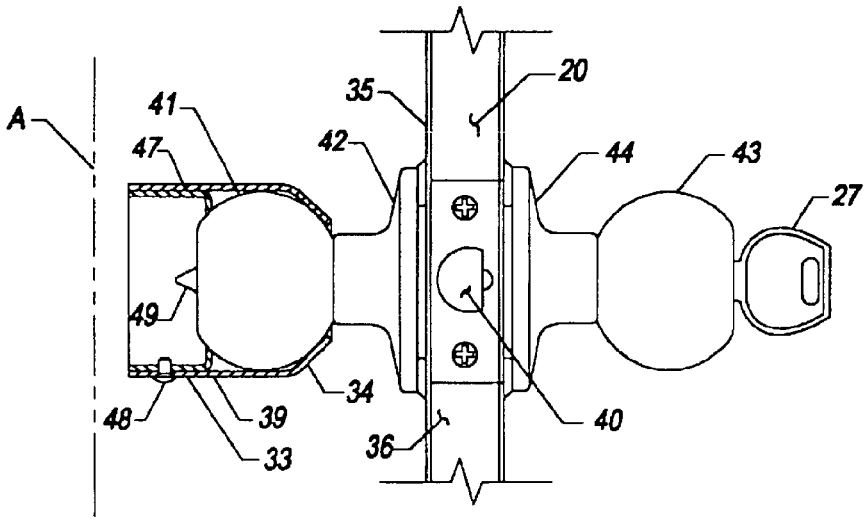

In FIGS. 9 through 11, inclusive, a separable protective shield 39 is shown in combination with the security door 20 and a single cylinder latch type lock 40. The lock 40 is retained in the security door 20 with a pair of threaded fasteners 30 which clamp an inner knob 41 and bezel 42 to an outer knob 43, bezel 44 and single cylinder lock assembly 45. The lock 40 is locked and unlocked from an interior of a building by a rotatable tang 49 which is mounted in the inner knob 41. The shield 39 is retained to the inner knob 41 with a lock ring 47 and threaded fastener 48 and rotates with the inner knob 41. To install the shield 39, the inner knob 41 and bezel 42 are removed by first removing the two threaded fasteners 30. The bezel 42 is removed from the inner knob 41, the shield 39 is positioned against the inner knob 41, the bezel 42 is re-assembled to the inner knob 41, and the inner knob 41, shield 39 and bezel 42 are mounted on the door 20 and the two threaded fasteners 30 are re-installed.

Figure 13:
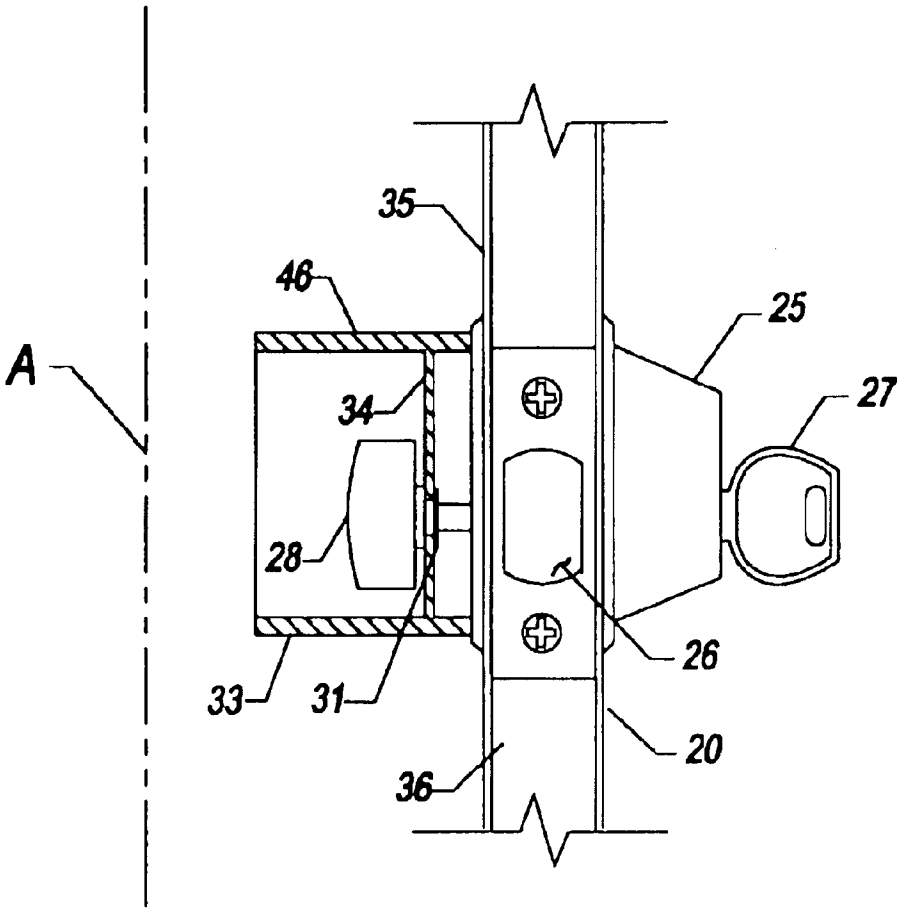
FIG. 13 is an enlarged end elevation view of the third embodiment.
Figure 12:
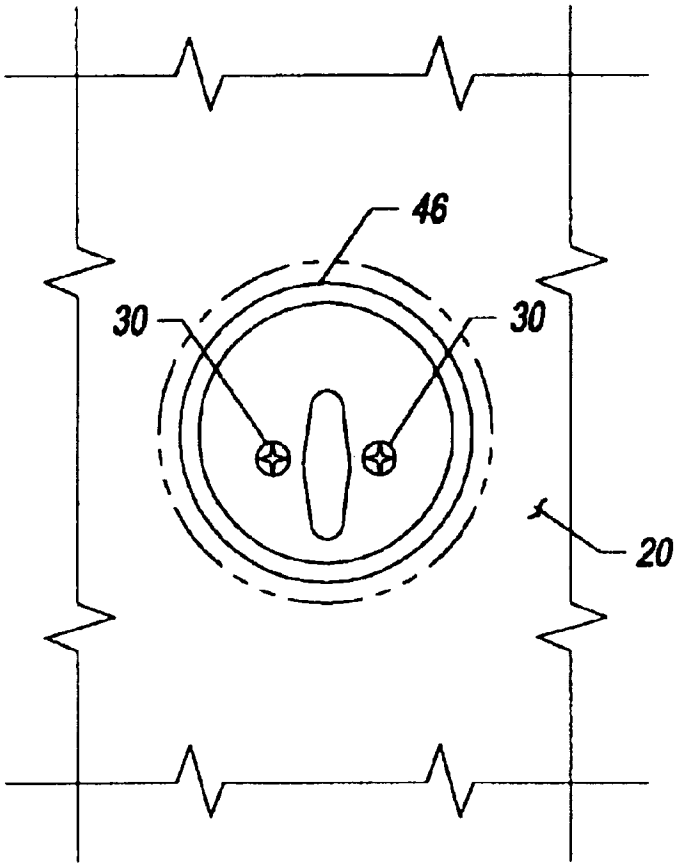
FIG. 12 is an enlarged partial rear elevation view of the third embodiment.

In FIGS. 12 and 13, a simple one-piece shield molded plastic shield 46 is shown in combination with the security door 20 and the single cylinder dead bolt lock 24. One benefit of this embodiment is that it eliminates the inner bezel 29 of the embodiment shown in FIGS. 3 through 5. The shield 46 is installed by removing the rotatable tang 28 and bezel 29 by first removing the two threaded fasteners 30, removing bezel 29 from the tang 28 by first removing the circlet clip 31, installing the shield 46 on the tang 28, re-installing the circlet clip 31, and installing the tang 28, shield 46 and two threaded fasteners 30.

From the foregoing it is apparent that my invention is a simple, cost effective method and kit for retrofitting existing security doors with a means for leaving a building during an emergency. Other benefits are that my invention applies to new as well as existing security doors and has numerous advantages over the prior art. Although only several embodiments are illustrated and described, it is will be appreciated that other embodiments can be derived by changes, such as substitution, elimination and shapes of parts, as well as changes in mater als and arrangements of parts which are known to persons skilled in the art without departing from the spirit thereof.

I claim:

1. In combination with an existing exterior prime entrance door, a security door spaced in front of said entrance door and a lock mounted in said security door for preventing intruders from entering a building, a simple cost effective kit for retrofitting said security door to provide a means for unlocking said existing security door from the interior of a said building during an emergency, said kit comprising a detachable shield positioned in a space between said prime entrance door and said security door, said shield having a thin cylindrical outer portion for enclosing in protective relationship an unlocking member of said ock, an adjoining orthogonal inward extending end portion for attaching said shield to a U-shaped inner bezel of said security door; and an opposite open end portion for exposing said unlocking member when said prime entrance door is opened, said open end portion being spaced a small distance apart from said prime entrance door to prevent exposing said unlocking member to said intruder through said security door when said prime entrance door is closed; and a threadable means for mechanically attaching said protective shield to said security door.

2. The combination set forth in claim 1 wherein said protective shield is attached to said security door in fixed relationship to said security door.

3. The combination set forth in claim 1 wherein said protective shield is attached to a rotatable member of said security door.

4. The combination set forth in claim 1 wherein said means for mechanically attaching said protective shield to said door is a pair of threaded fasteners for engaging said bezel and said lock.

5. The combination set forth in claim 4 wherein said lock is a single cylinder deadbolt lock and said unlocking means which is enclosed in said shield for unlocking said lock from said interior of a building is a rotatable tang.

6. The combination set forth in claim 1 wherein said shield is a single piece shield molded from a plastic material.

7. The combination recited in claim 1 wherein said unlocking member of said lock is removable from said lock.

8. The combination recited in claim 7 wherein said removable unlocking member of said lock is a key.

* * * * *

UNITED STATES PATENT AND TRADEMARK OFFICE

CERTIFICATE OF CORRECTION

PATENT NO. : 6,823,627 B1
DATED : November 30, 2004
INVENTOR(S) : Isaac Ben-Ezra It is certified that error appears in the above-identified patent and that said Letters Patent is hereby corrected as shown below:

Column 2,
Line 35, change “FIG. 10” to -- FIG. 11 --

Column 4,
Line 8, change “mater als” to -- materials --
Line 22, change “ock” to -- lock --

Signed and Sealed this

Eighth Day of March, 2005

JON W. DUDAS
*Director of the United States Patent and Trademark Office*